US009989916B2

(12) United States Patent
Yamaguchi et al.

(10) Patent No.: US 9,989,916 B2
(45) Date of Patent: Jun. 5, 2018

(54) IMAGE FORMING APPARATUS HAVING COUPLING STRUCTURE BETWEEN CARTRIDGE AND DRIVER UNIT

(71) Applicant: Brother Kogyo Kabushiki Kaisha, Nagoya-shi, Aichi-ken (JP)

(72) Inventors: Wataru Yamaguchi, Nisshin (JP); Masao Ichiyanagi, Ama (JP); Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/393,330

(22) Filed: Dec. 29, 2016

(65) Prior Publication Data

US 2017/0261916 A1 Sep. 14, 2017

(30) Foreign Application Priority Data

Mar. 11, 2016 (JP) ..... 2016-048886

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1647; G03G 21/1676
See application file for complete search history.

(56) References Cited

U.S. PATENT DOCUMENTS

| | | | | |
|---|---|---|---|---|
| 6,907,212 | B2 * | 6/2005 | Harada | G03G 15/757 399/167 |
| 8,229,324 | B2 * | 7/2012 | Takigawa | G03G 21/186 399/167 |
| 8,731,438 | B2 * | 5/2014 | Okabe | G03G 21/186 399/167 |
| 9,367,018 | B1 * | 6/2016 | Yanagawa | G03G 15/757 |
| 2007/0147875 | A1 * | 6/2007 | Hattori | G03G 15/6558 399/98 |
| 2008/0138113 | A1 * | 6/2008 | Murrell | G03G 15/757 399/167 |
| 2008/0138115 | A1 * | 6/2008 | Chadani | G03G 21/186 399/167 |
| 2009/0151969 | A1 * | 6/2009 | Huang | B25B 13/481 173/217 |

(Continued)

FOREIGN PATENT DOCUMENTS

| | | | |
|---|---|---|---|
| JP | 2001-225652 | A | 8/2001 |
| JP | 2011-059338 | A | 3/2011 |

*Primary Examiner* — G. M. Hyder
(74) *Attorney, Agent, or Firm* — Banner & Witcoff, Ltd.

(57) ABSTRACT

An image forming apparatus having a cartridge, a driver unit, a first universal joint, and a second universal joint, is provided. The cartridge is detachably attached to the image forming apparatus and has a first joint to receive a driving force from the image forming apparatus. The driver unit is configured to supply the driving force to the cartridge. The first universal joint is rotatable about a first axis and extends in a first direction based on the driving force. The second universal joint is coupled with the first universal joint and is rotatable along with the first universal joint. The second universal joint has a second joint coupled with the first joint and is rotatable along with the first joint.

12 Claims, 7 Drawing Sheets

(56) References Cited

U.S. PATENT DOCUMENTS

| | | | | |
|---|---|---|---|---|
| 2009/0196655 | A1* | 8/2009 | Takigawa | G03G 21/186 399/167 |
| 2010/0272470 | A1* | 10/2010 | Tomatsu | G03G 21/1623 399/167 |
| 2011/0058851 | A1 | 3/2011 | Okabe | |
| 2011/0217073 | A1* | 9/2011 | He | G03G 15/757 399/111 |
| 2012/0308265 | A1* | 12/2012 | Hashimoto | G03G 15/0194 399/167 |
| 2013/0084099 | A1* | 4/2013 | Hashimoto | G03G 15/0194 399/110 |
| 2013/0272753 | A1* | 10/2013 | Fukasawa | G03G 21/18 399/279 |
| 2014/0023396 | A1* | 1/2014 | Shiobara | G03G 15/757 399/167 |

* cited by examiner

IMAGE FORMING APPARATUS HAVING COUPLING STRUCTURE BETWEEN CARTRIDGE AND DRIVER UNIT

CROSS REFERENCE TO RELATED APPLICATION

This application claims priority under 35 U.S.C. § 119 from Japanese Patent Application No. 2016-048886, filed on Mar. 11, 2016. The entire subject matter of the application is incorporated herein by reference.

BACKGROUND

Technical Field

An aspect of the present disclosure relates to an image forming apparatus.

Related Art

An image forming apparatus with a detachable developer cartridge is known. The developer cartridge may include a developer roller and a coupling, to which a driving force from a driving source in the image forming apparatus may be transmitted. The developer roller may rotate by the driving force from the image forming apparatus transmitted through the coupling.

SUMMARY

The image forming apparatus may have a developer-drivable transmitter for transmitting the driving force to the coupling in the developer cartridge. The developer-drivable transmitter may include a gear and a slidable member. The slidable member may serve as a part of a universal joint. As a motor in the image forming apparatus is activated, the gear and the slidable member may rotate, and a coupling coupled with the slidable member may rotate along with the slidable member. It may be preferable that the slidable member in the universal joint tolerate eccentricity in a driving shaft so that the slidable member may transmit the driving force to the coupling stably.

The present disclosure is advantageous in that an image forming apparatus including a coupling, which may tolerate eccentricity in a driving shaft to restrain rotation irregularity, is provided.

According to an aspect of the present disclosure, an image forming apparatus having a cartridge, a driver unit, a first universal joint, and a second universal joint, is provided. The cartridge is detachably attached to the image forming apparatus and has a first joint to receive a driving force from the image forming apparatus. The driver unit is configured to supply the driving force to the cartridge. The first universal joint is rotatable about a first axis and extends in a first direction based on the driving force. The second universal joint is coupled with the first universal joint and is rotatable along with the first universal joint. The second universal joint has a second joint coupled with the first joint and is rotatable along with the first joint.

BRIEF DESCRIPTION OF THE ACCOMPANYING DRAWINGS

DETAILED DESCRIPTION

Hereinafter, an embodiment of the present disclosure will be described with reference to the accompanying drawings. It is noted that various connections may be set forth between elements in the following description. These connections in general, and unless specified otherwise, may be direct or indirect, and this specification is not intended to be limiting in this respect.

1. Overall Configuration of Image Forming Apparatus 100

Figure 1:
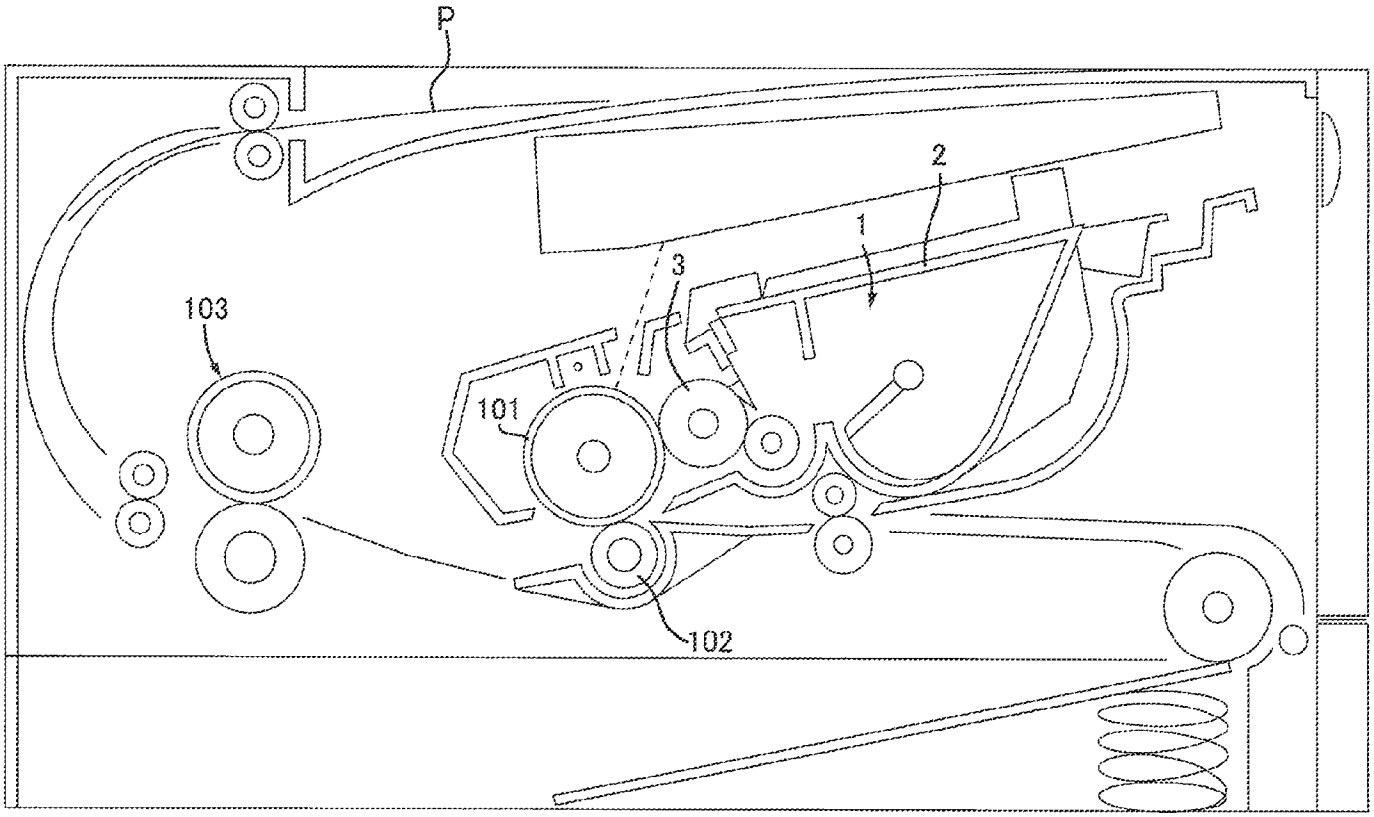
FIG. 1 is a schematic cross-sectional view of an image forming apparatus according to an embodiment of the present invention.

An overall configuration of an image forming apparatus 100 according to the embodiment will be described with reference to FIG. 1.

The image forming apparatus 100 may form an image on a sheet P in a developer agent. Specifically, the image forming apparatus 100 includes a developer cartridge 1 to store the developer agent. The developer cartridge 1 is detachably attached to the image forming apparatus 100. The developer agent may be, for example, a toner.

The image forming apparatus 100 further includes a photosensitive drum 101, a transfer roller 102, and a fuser 103. The image forming apparatus 100 may supply the developer agent in the developer cartridge 1 to a surface of the photosensitive drum 101 to form an image in the developer agent. The image formed on the surface of the photosensitive drum 101 in the developer agent may be transferred to the sheet P by the transfer roller 102, and the transferred image may be thermally fixed on the sheet P by the fuser 103. The image forming apparatus 100 may be a monochrome printer capable of forming an image in a single color or may be a multicolor printer capable of forming an image in multiple colors.

Figure 2:
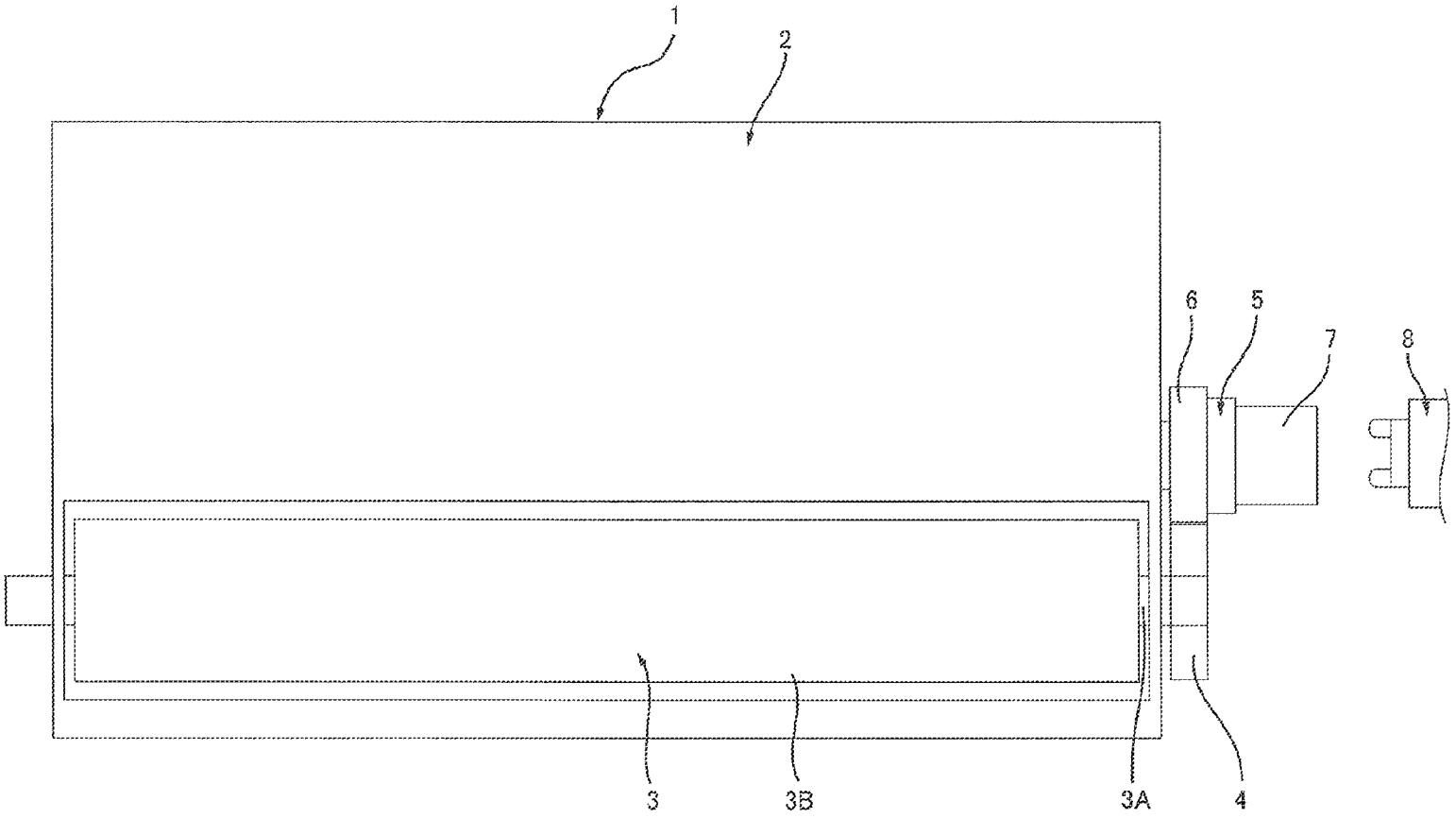
FIG. 2 is a schematic side view of a developer cartridge attachable to the image forming apparatus according to the embodiment of the present invention.

The image forming apparatus 100 includes a body-side coupling 8, as shown in FIG. 2, to input a driving force from a motor (not shown) to the developer cartridge 1. The body-side coupling 8 will be described later in detail.

Bellow will be described a detailed configuration of the developer cartridge 1. The developer cartridge 1 includes a housing 2, a developer roller 3, a developer-roller gear 4, and a cartridge-side coupling 5. The developer roller 3 is rotatable about an axis, which extends in a first direction. In other words, the first direction may be a direction of a rotation axis of the developer roller 3.

1.1 Housing 2

The housing 2 extends longitudinally in the first direction. The housing may store the developer agent therein.

1.2 Developer roller 3

The developer roller 3 is positioned at one side of the housing 2. A circumferential surface of the developer roller 3 is partly exposed outward from the housing 2. The developer roller 3 includes a developer-roller shaft 3A and a developer-roller body 3B. The developer-roller shaft 3A and the developer-roller body 3B extend longitudinally in the first direction. The developer-roller body 3B is formed to have a cylindrical shape and is rotatable along with the developer-roller shaft 3A.

1.3 Developer-Roller Gear 4

The developer-roller gear 4 is positioned outside the housing 2, in particular, at one side of the housing 2 in the first direction. The developer-roller gear 4 is positioned at one end portion of the developer-roller shaft 3A. In particular, the developer-roller gear 4 is mounted on the one end portion of the developer-roller shaft 3A and is rotatable along with the developer-roller shaft 3A. The developer-roller gear 4 includes a plurality of gear teeth (not shown), which are formed around a circumference of the roller gear 4 along a rotating direction of the developer-roller gear 4.

1.4 Cartridge-Side Coupling 5

The cartridge-side coupling 5 is positioned at one side of the housing 2 in the first direction, and the cartridge-side coupling 5 is positioned at an outer surface of the housing 2. The cartridge-side coupling 5 is rotatable about an axis extending in the first direction. The cartridge-side coupling 5 includes a coupling gear 6 and a first joint 7.

The coupling gear 6 is positioned between the housing 2 and the first joint 7 in the first direction. The coupling gear 6 includes a plurality of gear teeth (not shown), which are provided around a circumference of the coupling gear 6 along a rotating direction of the coupling gear 6. At least one of the gears in the coupling gear 6 is engageable with at least one of the gears in the developer-roller gear 4.

The first joint 7 is configured to receive a driving force from the image forming apparatus 100. The first joint 7 is positioned at the opposite side from the housing 2 relative to the coupling gear 6 in the first direction. The first joint 7 is rotatable along with the coupling gear 6. The first joint 7 includes a recess 7A (see FIG. 5), which is recessed toward the coupling gear 6 in the first direction. A contact part, which may contact a protrusion 43A and a protrusion 43B (see FIG. 4) in the body-side coupling 8 along a rotating direction of a gear 21 (see FIG. 4), is provided in the recess 7A. That is, the protrusions 43A, 43B of the body-side coupling 8 may be inserted in the recess 7A to contact the contact part so that the cartridge-side coupling 5 may engage with the body-side coupling 8 by the contact. Accordingly, the cartridge-side coupling 5 may rotate along with the body-side coupling 8.

2. Details of Driver Unit 11

Figure 3:
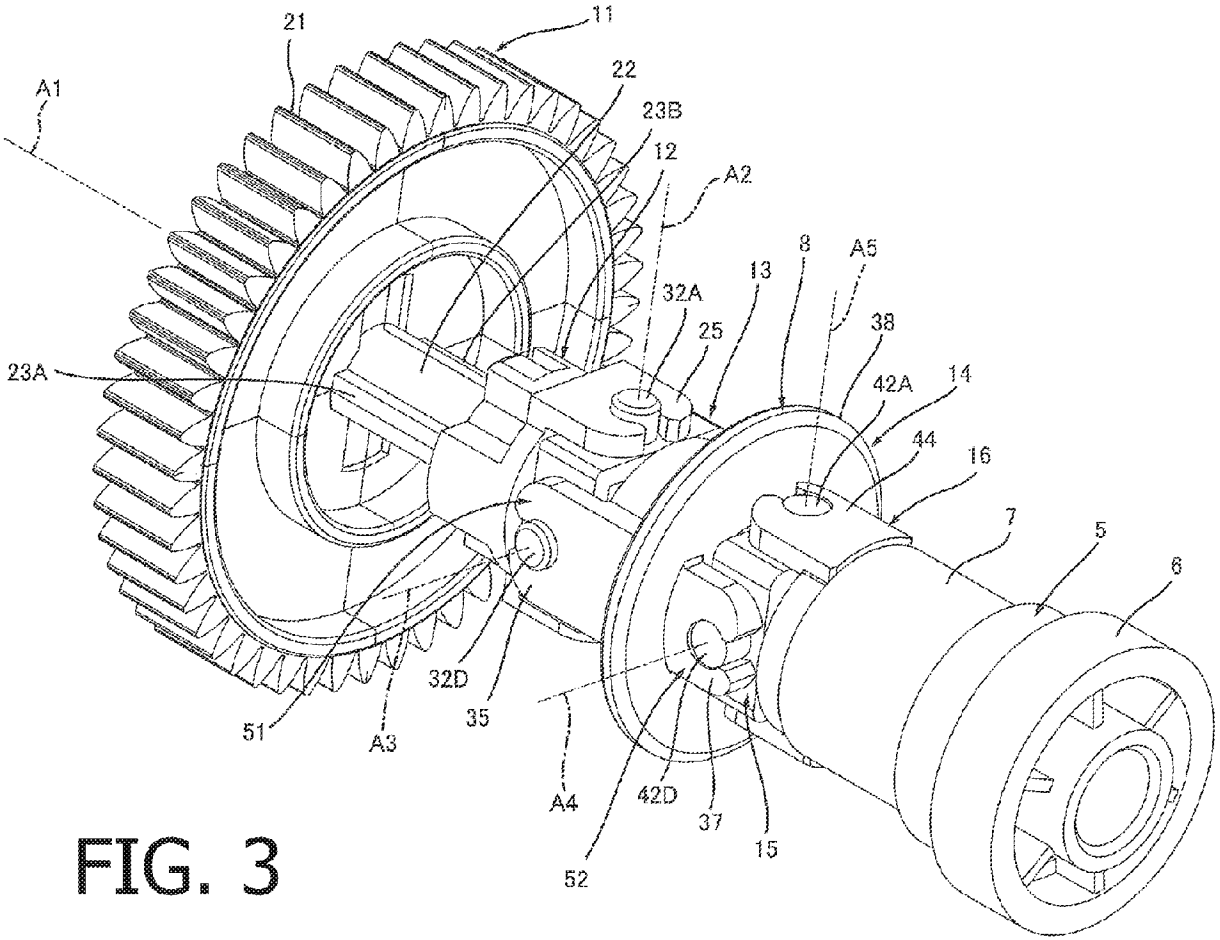
FIG. 3 is a perspective view of a cartridge-side coupling and a body-side coupling in the image forming apparatus according to the embodiment of the present invention.
Figure 4:
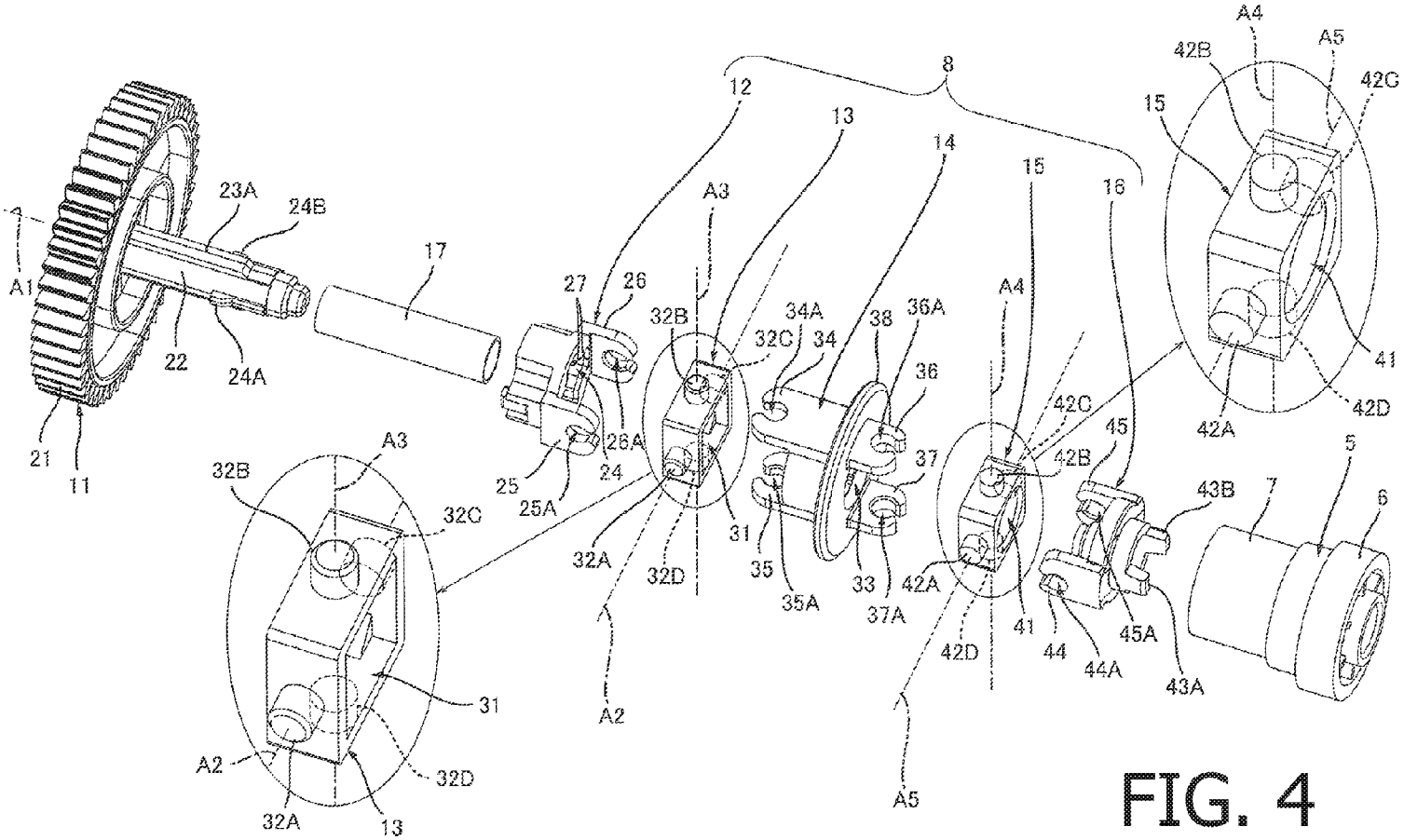
FIG. 4 is an exploded view of the body-side coupling in the image forming apparatus according to the embodiment of the present invention.
Figure 5:
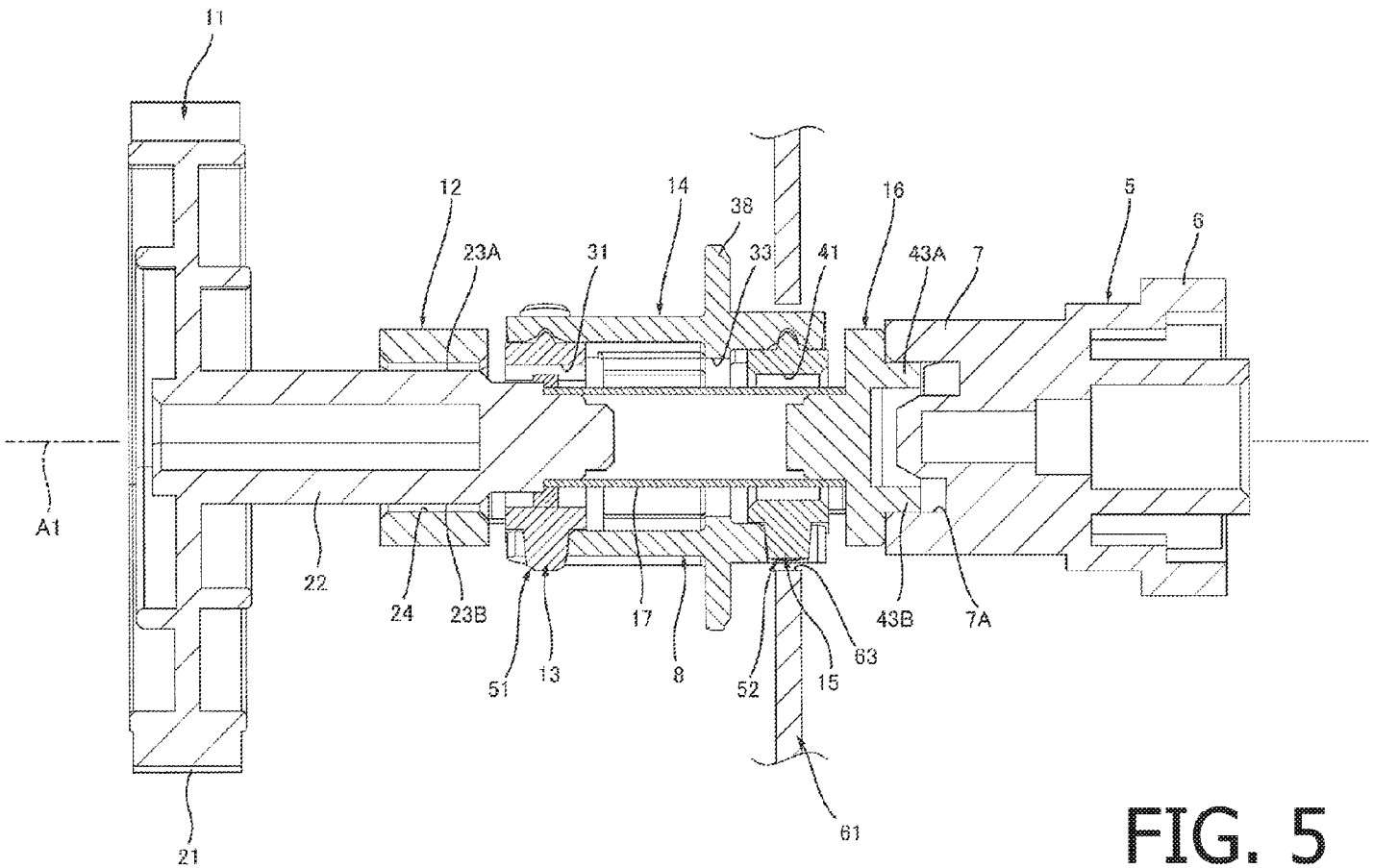
FIG. 5 is a cross-sectional view of the body-side coupling and the cartridge-side coupling with a second coupler being in a contact position in the image forming apparatus according to the embodiment of the present invention.

As shown in FIGS. 3-5, the image forming apparatus 100 includes a driver unit 11. The driver unit 11 may transmit the driving force from the motor (not shown) to the body-side coupling 8. The driver unit 11 includes the gear 21 and a shaft 22.

The gear 21 includes a plurality of gear teeth, which are provided around a circumference of the gear 21 along a rotating direction of the gear 21. The gear teeth are configured to receive the driving force from the motor in the image forming apparatus 100. Accordingly, the gear 21 may rotate about a first axis A1, which extends in the first direction.

The shaft 22 extends in the first direction along the first axis A1. The shaft 22 longitudinally extends from an end face of the gear 21 in the first direction toward the body-side coupling 8. The shaft 22 has one end portion and the other end portion in the first direction. The other end portion is farther apart from the gear 21 than the one end portion. The gear 21 is mounted to the one end portion of the shaft 22, and the shaft 22 is rotatable with the gear 21. In other words, the one end portion of the shaft 22 may be defined as a basal end and the other end of the shaft 22 may be defined as a tip end. The tip end is farther apart than the basal end from the gear 21, and the shaft 22 is attached to the gear 21 at the basal end. The shaft 22 rotates along with the gear 21. The shaft 22 includes a protrusion 23A and a protrusion 23B. The shaft 22 also includes a protrusion 24A and a protrusion 24B.

The protrusion 23A protrudes outward from a circumferential surface of the shaft 22 in a first radial direction of the shaft 22, and the protrusion 23B protrudes outward from the circumferential surface of the shaft 22 in a second radial direction of the shaft 22. The second radial direction is an opposite direction from the first radial direction relative to the first axis A1 of the shaft 22. The protrusion 23A and the protrusion 23B extend in the first direction, respectively.

The protrusion 24A protrudes outward from the circumferential surface of the shaft 22 in a third radial direction of the shaft 22. The protrusion 24A is positioned between the protrusion 23A and the protrusion 23B along a circumferential direction of the shaft 22. The protrusion 24B protrudes outward from the circumferential surface of the shaft 22 in a fourth radial direction of the shaft 22. The fourth radial direction is an opposite direction from the third radial direction relative to the first axis A1 of the shaft 22. The protrusion 24B is positioned between the protrusion 23A and the protrusion 23B along the circumferential direction of the shaft 22.

3. Details of the Body-Side Coupling 8

As shown in FIGS. 3-5, the body-side coupling 8 includes a first joint portion 12, a second joint portion 13, a third joint portion 14, a fourth joint portion 15, and a second joint 16.

3.1 Details of the First Joint Portion 12

The first joint portion 12 is coupled with the second joint portion 13. The first joint portion 12 has a through-hole 24. The through-hole 24 penetrates through the first joint portion 12 in the first direction. The shaft 22 is inserted into the through-hole 24.

A plurality of grooves 27 are provided at an inner surface of the through-hole 24. For example, the plurality of grooves 27 include four (4) grooves 27. When the shaft 22 is inserted in the through-hole 24, the protrusions 23A, 23B, 24A, and 24B are fitted into the corresponding groove among the four grooves 27, respectively. Therefore, the first joint portion 12 is rotatable along with the shaft 22. In other words, the first joint portion 12 is rotatable along with the gear 21. Accordingly, the first joint portion 12 is rotatable by the driving force from the driver unit 11 about the first axis A1. Thus, the driver unit 11 may transmit the driving force to the developer cartridge 1 through the body-side coupling 8.

The first joint portion 12 further includes a first bearing 25 and a second bearing 26. The first bearing 25 extends in the first direction toward the second joint 16. The second bearing 26 extends in the first direction toward the second joint 16. The first bearing 25 is positioned to be spaced apart from the second bearing 26 in a second direction, which intersects with the first direction. The first bearing 25 has a through-hole 25A. The through-hole 25A penetrates through the first bearing 25 in the second direction. The second bearing 26 has the same structure as the first bearing 25. The second bearing 26 has a through-hole 26A. At least a portion of the through-hole 25A overlaps at least a portion of the through-hole 25B in the second direction.

3.2 Details of the Second Joint Portion 13

The second joint portion 13 is positioned between the first joint portion 12 and the third joint portion 14 along the first direction. The second joint portion 13 has a through-hole 31. The through-hole 31 penetrates through the second joint portion 13 in the first direction. The shaft 22 is inserted into the through-hole 31. Further, a spring 17 is inserted into the through-hole 31. The spring 17 will be described later in detail. The second joint portion 13 further includes a shaft 32A extending in the second direction. Further, the second joint portion 13 includes a shaft 32C extending in the second direction. The shaft 32C is positioned at an opposite side from the shaft 32A relative to through-hole 31 in the second direction. The shaft 32A and the shaft 32C extend along a second axis A2, respectively. The shaft 32A and the shaft 32C have a cylindrical shape, respectively. The second joint portion 13 includes one end portion and the other end portion separated from the one end portion of the second joint portion 13 in the second direction. The shaft 32A extends outward from the one end portion of the second joint portion 13 in the second direction. The shaft 32C extends outward from the other end portion of the second joint portion 13 in the second direction. The shaft 32A is inserted into the through-hole 25A of the first bearing 25, and the shaft 32A is fitted into the through-hole 25A of the first bearing 25. Therefore, the first bearing 25 can receive the shaft 32A. The shaft 32C is also inserted into the through-hole 26A of the second bearing 26, and the shaft 32C is fitted into the through-hole 26A of the second bearing 26. Therefore, the second bearing 26 can receive the shaft 32C. Thereby, the second joint portion 13 may pivot with respect to the first joint portion 12 about the second axis A2. The second axis A2 extends in the second direction intersecting with the first direction. In other words, the second direction may extend along a radial direction of the gear 21, and the second direction may intersect with the first direction. The second direction may intersect orthogonally with the first direction.

The second joint portion 13 further includes a shaft 32B extending in a third direction. The second joint portion 13 also includes a shaft 32D extending in the third direction. The third direction intersects with the first direction and with the second direction. In other words, the third direction may extend in a radial direction of the gear 21 and intersects with the first direction and the second direction. The third direction may intersect orthogonally with the first direction and with the second direction.

The shaft 32D is located on an opposite side from the shaft 32B relative to the through-hole 31 in the second direction. The shaft 32B and the shaft 32D extend along a third axis A3, respectively. The shaft 32B and the shaft 32D have a cylindrical shape, respectively. The second joint portion 13 includes one end portion and the other end portion separated from the one end portion of the second joint portion 13 in the third direction. The shaft 32B extends outward from the one end portion of the second joint portion 13 in the third direction, and the shaft 32D extends outward from the other end portion of the second joint portion 13 in the third direction. The shaft 32B is inserted into a through-hole 34A of a first bearing 34, which will be described later. The shaft 32B is fitted into the through-hole 34A. Therefore, the first bearing 34 can receive the shaft 32B. The shaft 32D is inserted into a through-hole 35A of a second bearing 35, which will be described later. The shaft 32D is fitted into the through-hole 35A. Therefore, the second bearing 35 can receive the shaft 32D. Thereby, the second joint portion 13 may pivot with respect to the third joint portion 14 about the third axis A3.

3.3 Details of the Third Joint Portion 14

Bellow will be described the third joint portion 14. The third joint portion 14 is positioned at an opposite side of the first joint portion 12 relative to the second joint portion 13 in the first direction. The third joint potion 14 is positioned between the second joint portion 13 and the fourth joint portion 15 in the first direction. The third joint portion 14 has a through-hole 33. The through-hole 33 penetrates through the third joint portion 14 in the first direction. The spring 17 which will be described later is inserted into the through-hole 33. The third joint portion 14 is coupled with the second joint portion 13.

Specifically, the third joint portion 14 includes the first bearing 34 and the second bearing 35. The first bearing 34 and the second bearing 35 are positioned at one end portion of the third joint portion 14 in the first direction. The first bearing 34 is positioned to be spaced apart from the second bearing 35 in the third direction. The first bearing 34 is positioned at an opposite side from the second bearing 35 relative to the through-hole 33 along the third direction. The first bearing 34 has a through-hole 34A. The through-hole 34A penetrates through the first bearing 34 in the third direction. The shaft 32B is inserted into the through-hole 34A, and the shaft 32 B is fitted into the through-hole 34A. Therefore, the first bearing 34 can receive the shaft 32B. The second bearing 35 has the same structure as the first bearing 34. The second bearing 35 has a through-hole 35A. The shaft 32D is inserted into the through-hole 35A, and the shaft 32D is fitted into the through-hole 35A. Therefore, the second bearing 35 can receive the shaft 32D. At least a portion of the through-hole 34A overlaps at least a portion of the through-hole 35B in the third direction.

The third joint portion 14 further includes a third bearing 36 and a fourth bearing 37. The first bearing 34 and the second bearing 35 are positioned at one side of the third joint portion in the first direction, respectively. The third bearing 36 and the fourth bearing 37 are positioned at the other side of the third joint portion 14 in the first direction, respectively. The third bearing 36 is positioned to be spaced apart from the fourth bearing 37 in the third direction. The third bearing 36 is positioned at an opposite side of the fourth bearing 37 relative to the through-hole 33 in the third direction. The third bearing 36 has a through-hole 36A. The through-hole 36A penetrates through the third bearing 36 in the third direction. The fourth bearing 37 has the same structure as the third bearing 36. The fourth bearing 37 has a through-hole 37A. At least a portion of the through-hole 36A overlaps at least a portion of the through-hole 37B in the third direction. The third joint portion 14 is coupled with the fourth joint portion 15, which will be described later.

The third joint portion 14 further includes a plate member 38. The plate member 38 is positioned between the first bearing 34 and the third bearing 36 in the first direction. The plate member 38 extends in a direction orthogonal to the first direction. For example, the plate member 38 may extend in the radial direction of the gear 21. The plate member 38 has a shape of a disc centered at the first axis A1.

3.4 Details of the Fourth Joint Portion 15

The fourth joint portion 15 is positioned between the third joint portion 14 and the second joint 16 in the first direction. The fourth joint portion 15 has a through-hole 41. The through-hole 41 penetrates through the fourth joint portion 15 in the first direction. The spring 17 which will be described later is inserted into the through-hole 41.

The fourth joint portion 15 includes a shaft 42A extending along the second direction. The fourth joint portion 15 also includes a shaft 42C extending along the second direction. The shaft 42C is positioned at an opposite side from the shaft 42A relative to the through-hole 41 in the second direction. The shaft 42A and the shaft 42C have a cylindrical shape, respectively. The shaft 42A and the shaft 42C extend along a fifth axis A5, respectively. The shaft 42A extends outward from one end portion of the fourth joint portion 15 in the second direction, and the shaft 42C extends outward from the other end portion of the fourth joint portion 15 in the second direction. The other end portion of the fourth joint portion is separated from the one end portion of the fourth joint portion in the second direction.

The fourth joint portion 13 further includes a shaft 42B extending in the third direction. The fourth joint portion also includes a shaft 42D extending in the third direction. The shaft 42D is positioned at an opposite side from the shaft 42B relative to the through-hole 41 in the third direction. The shaft 42B and the shaft 42D have a cylindrical shape, respectively. The shaft 42B and shaft 42D extend along a fourth axis A4, respectively. The shaft 42B is inserted into the through-hole 36A of the third bearing 36, and the shaft 42B is fitted into the through-hole 36A of the third bearing 36. Therefore, the third bearing 36 can receive the shaft 42B. The shaft 42D is also inserted into the through-hole 37A of the fourth bearing 37, and the shaft 42D is fitted into the through-hole 37A of the fourth bearing 37. Therefore, the fourth bearing 37 can receive the shaft 42D. Thereby, the fourth joint portion 15 may pivot with respect to the third joint portion 14 about the fourth axis A4 extending in the third direction. The fourth joint portion 15 is coupled with the second joint 16.

3.5 Details of the Second joint 16

Bellow will be described the second joint 16. The second joint 16 is positioned at an opposite side of the third joint portion 14 relative to the fourth joint portion 15 in the first direction. The second joint 16 is coupled with the fourth joint portion 15. The second joint 16 includes a first bearing 44 and a second bearing 45, which are positioned at one end portion thereof in the first direction. The second bearing 45 is positioned to be spaced apart from the first bearing 44 in the second direction. The first bearing 44 has a through-hole 44A. The through-hole 44A penetrates through the first bearing 44 in the second direction. The shaft 42A is inserted into the through-hole 44A, and the shaft 42A is fitted into the through-hole 44A. Therefore, the first bearing 44 can receive the shaft 42A. The second bearing 45 has the same structures as the first bearing 44. The second bearing 45 has a through-hole 45A. The through-hole 45A penetrates through the second bearing 45 in the second direction. The shaft 42C is inserted into the through-hole 45A, and the shaft 42C is fitted into the through-hole 45A. Therefore, the second bearing 45 can receive the shaft 42C. At least a portion of the through-hole 44A overlaps at least a portion of the through-hole 45A in the second direction. Therefore, the second joint 16 may pivot with respect to the second joint portion 15 about the fifth axis A5 extending in the second direction.

The second joint 16 further includes a protrusion 43A and a protrusion 43B, which are positioned at the other end portion of the second joint 16 in the first direction. The other end portion of the second joint 16 is separated from the one end portion of the second joint 16 in the first direction. The protrusion 43A and the protrusion 43B protrude from the other end portion of the second joint 16 in the first direction. The protrusion 43A and the protrusion 43B are spaced apart from each other in the radius direction of the gear 21. Specifically, the protrusion 43A and the protrusion 43B are spaced apart from each other along the second direction. When both the protrusion 43A and the protrusion 43B contact the contact part of the first joint 7, the second joint 16 can rotate along with the first joint 7. Thereby, the cartridge-side coupling 5 can rotate along with the body-side coupling 8.

In this regard, the first joint portion 12, the second joint portion 13, the first bearing 34 of the third joint portion 14, and the second bearing 35 of the third joint portion 14 form a first universal joint 51. Thus, the image forming apparatus 100 includes the first universal joint 51. The first universal joint 51 is positioned between a second universal joint 52 and the driver unit 11 in the first direction. The first universal joint 51 has the through-hole 24, the through-hole 31, and the through-hole 33. The first universal joint 51 may be a cardan joint.

Meanwhile, the third bearing 36 of the third joint portion 14, the fourth bearing 37 of the third joint portion 14, the fourth joint portion 15, and the second joint 16 form the second universal joint 52. Thus, the image forming apparatus 100 includes the second universal joint 52. The second universal joint 52 has the through-hole 41. The second universal joint 52 includes the second joint 16. The second universal joint 52 may be a cardan joint. The second universal joint 52 is coupled with the first universal joint 51 via the third joint portion 14. Therefore, the second universal joint 52 may rotate along with the first universal joint 51.

4. Spring 17

The image forming apparatus 100 further includes the spring 17. The spring 17 is an example of an elastic member.

The spring 17 is positioned between the second joint 16 and the shaft 22 along the first direction. The spring 17 is mounted on the second joint 16 at one end thereof and to the tip end of the shaft 22 at the other end thereof. Therefore, the spring 17 is connected with the driver unit 11 and with the second joint 16. The spring 17 is inserted into the through-hole 31 of the second joint portion 13, the through-hole 33 of the second joint portion 14, and the through-hole 41 of the fourth joint portion 15. The spring 17 may expand or contract in the first direction.

Meanwhile, the second joint 16 is movable in the first direction between a contact position (see FIG. 5) and a separated position (see FIG. 6) in a state where the developer cartridge 1 is attached to the image forming apparatus 100. The contact position is a position, in which the second joint 16 contacts the first joint 7 of the cartridge-side coupling 5. The separated position is a position, in which the second joint 16 is separated from the first joint 7.

The spring 17 is contracted by the second joint 16 moving from the contact position toward the separated position. More specifically, the second joint 16 is movable along the first direction from a position closer to the contact position toward a position closer to the separated position against an elastic force of the spring 17.

The spring 17 expands to move the second joint 16 toward the contact position. More specifically, the second joint 16 can move along the first direction from the position closer to the separated position toward a position closer to the contact position due to the resilient force of the spring 17.

In this regard, when the second joint 16 moves, the first joint portion 12, the second joint portion 13, the third joint portion 14, and the fourth joint portion 15 move along with the second joint 16.

5. Linear Motion Cam 61

Figure 7:
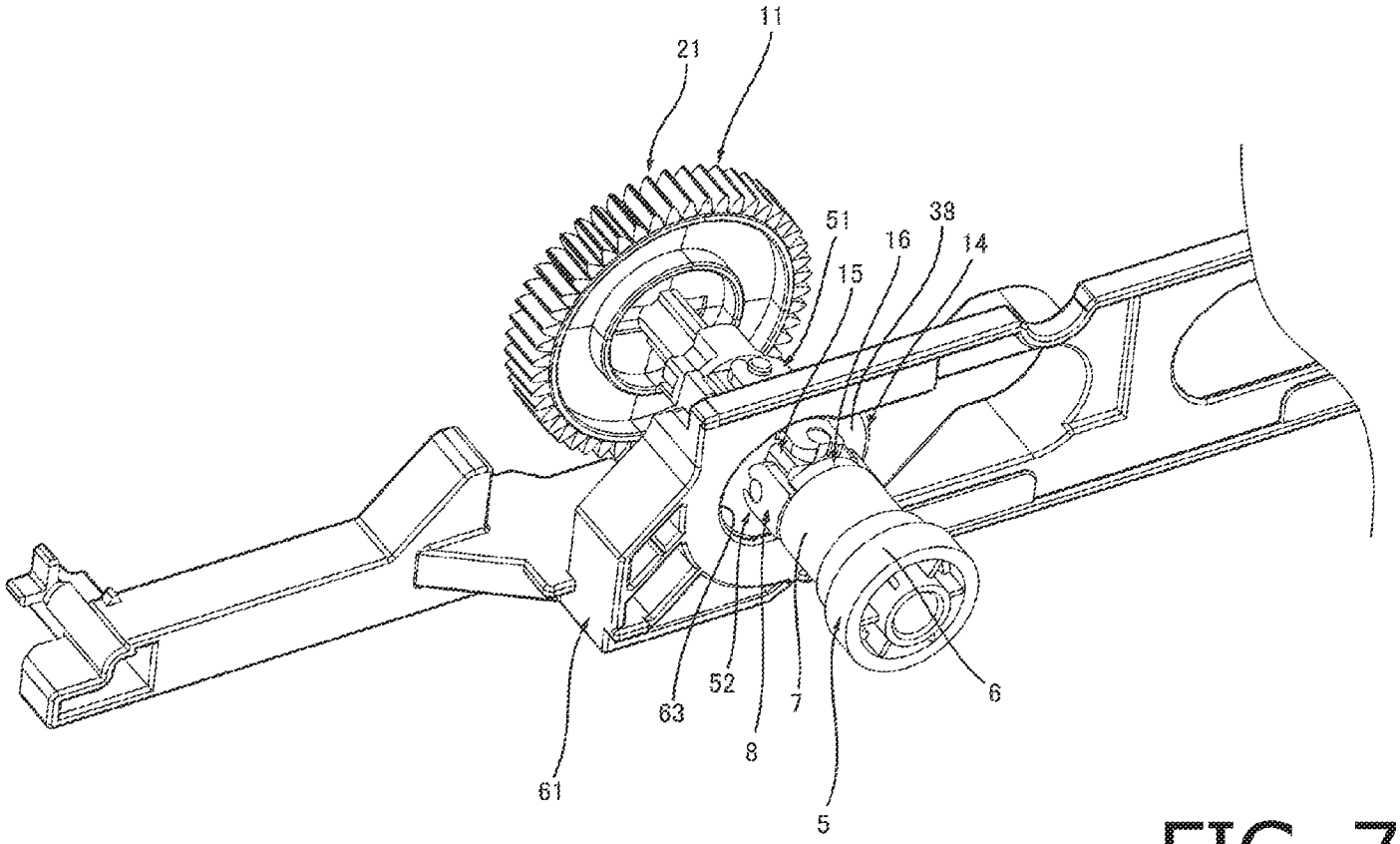
FIG. 7 is an illustrative perspective view of a linear motion cam in the image forming apparatus according to the embodiment of the present invention.

The image forming apparatus 100 includes, as shown in FIG. 7, a linear motion cam 61.

Figure 6:
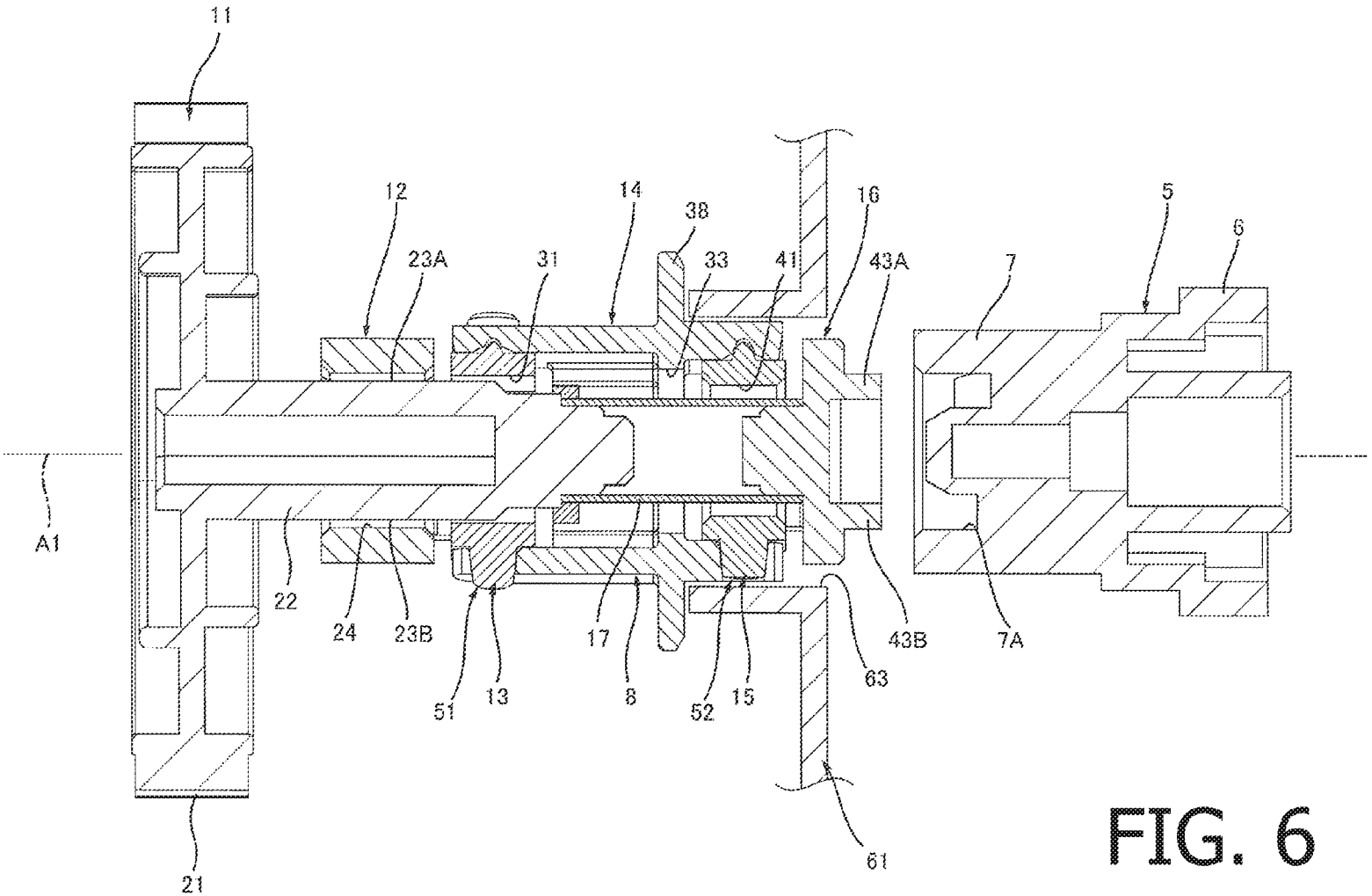
FIG. 6 is a cross-sectional view of the body-side coupling and the cartridge-side coupling with the second joint being in a separated position in the image forming apparatus according to the embodiment of the present invention.

The linear motion cam 61 is a structure for allowing the second joint 16 to be positioned at the separated position. The linear motion cam 61 is movable between a first position, in which the linear motion cam 61 applies pressure to the second universal joint 52, and a second position (see FIG. 7), in which the linear motion cam 61 releases the second universal joint 52 from the pressure. The linear motion cam 61 is movable in a direction orthogonal to the first direction. The linear motion cam 61 may be moved in the direction orthogonal to the first direction when, for example, the developer cartridge 1 is to be attached to or detached from the image forming apparatus 100. When the linear motion cam 61 is in the first position, as shown in FIG. 6, the linear motion cam 61 presses the plate member 38 of the third joint portion 14 and allows the second joint 16 to be positioned at the separated position. On the other hand, when the linear motion cam 61 is in the second position, as shown in FIG. 5, the linear motion cam 61 releases the plate member 38 to allow the second joint 16 to be positioned at the contact position.

Bellow will be described detailed configuration of the linear motion cam 61 with reference to FIG. 7. The linear motion cam 61 has a through-hole 63.

The through-hole 63 penetrates through the linear motion cam 61 in the first direction. The through-hole 63 is elongated in a movable direction for the linear motion cam 61. The second universal joint 52 is inserted into the through-hole 63. Specifically, the third joint portion 14, the fourth joint portion 15, and the second joint 16 are inserted into the through-hole 63. Meanwhile, the plate member 38 of the third joint portion 14 is positioned at an opposite side from the cartridge-side coupling 5 relative to the through-hole 63.

The body-side coupling 8 includes the second universal joint 52. When the second joint 16 is in the separated position, as shown in FIG. 6, the second universal joint 52 might bow in the vertical direction downward due to the effect of gravity, because the second universal joint 52 is not connected with the first joint 7. When the second universal joint 52 bows downward to a large extent, the second joint 16 might be drawn downward to be lower than the first joint 7.

In this regard, at least any one of the third joint portion 14, the fourth joint portion 15, and the second joint 16 is inserted into the through-hole 63, and at least any one of the third joint portion 14, the fourth joint portion 15, and the second joint 16 which is inserted into the through-hole 63 can contact an inner surface of the through-hole 63. In other words, when the second joint 16 is in the separated position, the second universal joint 52 is in contact with the linear motion cam 61 along the vertical direction. At least any one of the third joint portion 14, the fourth joint portion 15, and the second joint 16 is in contact with the inner surface of the through-hole 63; thereby, the second joint 16 can be restrained from sinking downward. In other words, the inner surface of the through-hole 63 can restrict the second joint 16 from sinking by contacting the second universal joint 52.

6. Connection Between the Body-Side Coupling 8 and the Cartridge-Side Coupling 5

When the developer cartridge 1 is attached to the image forming apparatus 100 and the linear motion cam 61 is in the first position, as shown in FIG. 6, the linear motion cam 61 can press the plate member 38 of the third joint portion 14. Thereby, the second joint 16 can be positioned in the separated position against the urging force of the spring 17.

On the other hand, when the linear motion cam 61 is in the second position, as shown in FIGS. 5 and 7, the second joint 16 can be positioned in the contact position by the urging force of the spring 17 in the first direction.

Therefore, the second joint 16 is in contact with the first joint 7 of the cartridge-side coupling 5.

Further, the protrusion 43A and the protrusion 43B of the second joint 16 can be received by the recess 7A of the first joint 7; thereby, the cartridge-side coupling 5 can rotate along with the body-side coupling 8.

Therefore, when the gear 21 receives driving force, the body-side coupling 8 and the cartridge-side coupling 5 can rotate with each other.

In this regard, the rotation axis (e.g., the first axis A1) of the gear 21 and the rotation axis of the coupling gear 6 may or may not necessarily align with each other.

7. Benefits

The body-side coupling 8 includes, as shown in FIGS. 3-4, the first universal joint 51 including the first joint portion 12, the second joint portion 13, and the first bearing 34 and the second bearing 35 of the third joint portion 14; and the second universal joint 52 including the third bearing 36 and the fourth bearing 37 of the third joint portion 14, the fourth joint portion 15, and the second joint 16.

With this configuration, when the body-side coupling 8 is connected to the cartridge-side coupling 5, the two universal joints such as the first universal joint 51 and the second universal joint 52 are interposed between the gear 21 and the first joint 7 along the first direction.

Therefore, even when the rotation axis (e.g., the first axis A1) of the gear 21 and the rotation axis of the coupling gear 6 are not aligned with each other, the deviation of the rotation axis (e.g., the first axis A1) of the gear 21 with respect to the rotation axis of the coupling gear 6 can be absorbed by the first universal joint 51 and second universal joint 52 so that the body-side coupling 8 and the cartridge-side coupling 5 can be connected with each other.

Furthermore, the first joint portion 12 is pivotable with respect to the second joint portion 13 about the second axis A2 extending in the second direction. The third joint portion 14 is pivotable with respect to the second joint portion 13 about the third axis A3 extending in the third direction. The fourth joint portion 15 is pivotable with respect to the third joint portion 14 about the fourth axis A4 extending in the third direction. Further, the second joint 16 is pivotable with respect to the fourth joint portion 15 about the fifth axis A5 extending in the second direction.

With this configuration, when both the body-side coupling 8 and the cartridge-side coupling 5 rotate, while the rotation axis of the gear 21 and the rotation axis of the coupling gear 6 are not aligned, fluctuation in rotation velocity of the cartridge-side coupling 5 with respect to a rotation velocity of the body-side coupling 8 can be restrained.

Accordingly, eccentricity in the rotation axis (e.g., the first axis A1) of the gear 21 with respect to the rotation axis of the coupling gear 6 can be absorbed, and the driving force can be transmitted to the cartridge-side coupling 5 stably.

Further, the second joint portion 13 is pivotable with respect to the third joint portion 14 about the third axis A3 extending in the third direction, and the fourth joint portion 15 is, similarly to the second joint portion 13, pivotable with respect to the third joint portion 14 about the fourth axis A4 extending in the third direction. In this regard, if the fourth joint portion 15 is pivotable with respect to the third joint portion 14 about an axis extending orthogonally to the third axis A3, the third joint portion 14 can amplify a difference in rotation phases. Meanwhile, according to the embodiment described above, the fourth joint portion 15 is pivotable, similarly to the second joint portion 13, with respect to the third joint portion 14 about the fourth axis A4 extending in the third direction; therefore, while absorbing the eccentricity in the rotation axis of the coupling gear 6, the fourth joint portion 15 can transmit the driving force to the cartridge-side coupling 5 stably.

8. More Examples

Although an example of carrying out the present disclosure have been described, those skilled in the art may recognize that there are numerous variations and permutations of the image forming apparatus that fall within the spirit and scope of the invention as set forth in the appended claims. It may be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the body-side coupling 8 may not necessarily mate with the cartridge-side coupling 5 of the developer cartridge 1 but may mate with a coupling in, for example, a drum cartridge or a processing cartridge, as long as the cartridge is detachably attachable to the image forming apparatus 100.

For another example, the spring 17 may be replaced with elastic rubber, as long as it is expandable or contractive in the first direction.

For another example, the shaft 22 may not necessarily be formed integrally with the gear 21 but may be formed separately from the gear 21 and attached to the gear 21 as long as the shaft 22 is rotatable along with the gear 21.

What is claimed is:

1. An image forming apparatus comprising:

a cartridge detachably attachable to the image forming apparatus, the cartridge comprising a first coupling member configured to receive a driving force from the image forming apparatus;

a driver unit configured to supply the driving force to the cartridge;

a first universal joint rotatable about a first axis extending in a first direction based on the driving force;

a second universal joint coupled with the first universal joint, the second universal joint being rotatable along with the first universal joint, the second universal joint comprising a second coupling member coupled with the first coupling member and being rotatable along with the first coupling member, wherein the second coupling member is movable in the first direction between a contact position, in which the second coupling member is in contact with the first coupling member, and a separated position, in which the second coupling member is separated from the first coupling member; and an elastic member contractive or expandable in the first direction, the elastic member being connected with the driver unit and the second coupling member, wherein the elastic member is configured to move the second coupling member from the separated position to the contact position when the elastic member, contracted by the second coupling member moving along the first direction from the contact position to the separated position, expands.

2. The image forming apparatus according to claim 1, wherein the first universal joint is positioned between the second universal joint and the driver unit along the first direction.

3. The image forming apparatus according to claim 1, wherein the driver unit comprises:

a gear rotatable about the first axis; and a shaft extending in the first direction and being rotatable along with the gear, the gear being mounted to one end portion of the shaft in the first direction, wherein the elastic member is mounted to the other end of the shaft in the first direction, wherein the first universal joint has a first through-hole penetrating through the first universal joint in the first direction, wherein the second universal joint has a second through-hole penetrating through the second universal joint in the first direction, wherein the shaft is inserted in at least the first through-hole and is rotatable along with the first universal joint, and wherein the elastic member is inserted in the first through-hole and in the second through-hole and is mounted to the second coupling member.

4. The image forming apparatus according to claim 1, further comprising:

a linear motion cam movable between a first position, in which the linear motion cam applies pressure to the second universal joint and allows the second coupling member to be positioned at the separated position, and a second position, in which the linear motion cam releases the second universal joint from the pressure; and wherein the second universal joint is in contact with the linear motion cam in a second direction intersecting with the first direction, when the second coupling member is in the separated position.

5. The image forming apparatus according to claim 4, wherein the second universal joint comprises a plate extending in a direction intersecting with the first direction, wherein the linear motion cam moves the second coupling member from the contact position to the separated position by applying pressure to the plate, and wherein the linear motion cam moves the second coupling member from the separated position to the contact position by releasing the plate from the pressure.

6. An image forming apparatus comprising:

a cartridge detachably attachable to the image forming apparatus, the cartridge comprising a first coupling member configured to receive a driving force from the image forming apparatus;

a driver unit configured to supply the driving force to the cartridge, the driver unit comprising:

a gear rotatable about a first axis extending in a first direction; and a shaft extending in the first direction and being rotatable along with the gear, the gear being mounted to one end portion of the shaft in the first direction;

a first universal joint rotatable about the first axis based on the driving force and having a first through-hole penetrating through the first universal joint in the first direction;

a second universal joint coupled with the first universal joint, the second universal joint being rotatable along with the first universal joint, the second universal joint comprising a second coupling member coupled with the first coupling member and being rotatable along with the first coupling member, the second universal joint having a second through-hole penetrating through the second universal joint in the first direction; and an elastic member contractive or expandable in the first direction, the elastic member being mounted to the other end of the shaft in the first direction, wherein the shaft is inserted in at least the first through-hole and is rotatable along with the first universal joint, and wherein the elastic member is inserted in the first through-hole and in the second through-hole and is mounted to the second coupling member.

7. The image forming apparatus according to claim 6, wherein the first universal joint is positioned between the second universal joint and the driver unit along the first direction.

8. The image forming apparatus according to claim 6, wherein the second coupling member is movable in the first direction between a contact position, in which the second coupling member is in contact with the first coupling member, and a separated position, in which the second coupling member is separated from the first coupling member, wherein the image forming apparatus further comprises:

a linear motion cam movable between a first position, in which the linear motion cam applies pressure to the second universal joint and allows the second coupling member to be positioned at the separated position, and a second position, in which the linear motion cam releases the second universal joint from the pressure, and wherein the second universal joint is in contact with the linear motion cam in a second direction intersecting with the first direction, when the second coupling member is in the separated position.

9. The image forming apparatus according to claim 8, wherein the second universal joint comprises a plate extending in a direction intersecting with the first direction, wherein the linear motion cam moves the second coupling member from the contact position to the separated position by applying pressure to the plate, and wherein the linear motion cam moves the second coupling member from the separated position to the contact position by releasing the plate from the pressure.

10. An image forming apparatus comprising:

a cartridge detachably attachable to the image forming apparatus, the cartridge comprising a first coupling member configured to receive a driving force from the image forming apparatus;

a driver unit configured to supply the driving force to the cartridge;

a first universal joint rotatable about a first axis extending in a first direction based on the driving force;

a second universal joint coupled with the first universal joint, the second universal joint being rotatable along with the first universal joint, the second universal joint comprising a second coupling member coupled with the first coupling member and being rotatable along with the first coupling member, wherein the second coupling member is movable in the first direction between a contact position, in which the second coupling member is in contact with the first coupling member, and a separated position, in which the second coupling member is separated from the first coupling member; and a linear motion cam movable between a first position, in which the linear motion cam applies pressure to the second universal joint and allows the second coupling member to be positioned at the separated position, and a second position, in which the linear motion cam releases the second universal joint from the pressure, wherein the second universal joint is in contact with the linear motion cam in a second direction intersecting with the first direction, when the second coupling member is in the separated position.

11. The image forming apparatus according to claim 10, wherein the first universal joint is positioned between the second universal joint and the driver unit along the first direction.

12. The image forming apparatus according to claim 10, wherein the second universal joint comprises a plate extending in a direction intersecting with the first direction, wherein the linear motion cam moves the second coupling member from the contact position to the separated position by applying pressure to the plate, and wherein the linear motion cam moves the second coupling member from the separated position to the contact position by releasing the plate from the pressure.

* * * * *